US007771174B2

(12) United States Patent
Lenhart

(10) Patent No.: US 7,771,174 B2
(45) Date of Patent: Aug. 10, 2010

(54) RECIPROCATING SLURRY PUMP WITH A CONTINUOUS FEED RATE

(75) Inventor: Manfred Lenhart, Haltern am See (DE)

(73) Assignee: Schwing GmbH, Herne (DE)

( * ) Notice: Subject to any disclaimer, the term of this patent is extended or adjusted under 35 U.S.C. 154(b) by 827 days.

(21) Appl. No.: 10/572,821

(22) PCT Filed: Sep. 15, 2004

(86) PCT No.: PCT/EP2004/010352

§ 371 (c)(1),
(2), (4) Date: Dec. 8, 2006

(87) PCT Pub. No.: WO2005/033508

PCT Pub. Date: Apr. 14, 2005

(65) Prior Publication Data

US 2007/0196224 A1 Aug. 23, 2007

(30) Foreign Application Priority Data

Sep. 22, 2003 (DE) ..... 103 43 802

(51) Int. Cl.
*F04B 49/06* (2006.01)
*F04B 39/10* (2006.01)

(52) U.S. Cl. ..... 417/53; 417/532; 417/900

(58) Field of Classification Search ..... 417/53, 417/532, 900

See application file for complete search history.

(56) References Cited

U.S. PATENT DOCUMENTS 3,663,129 A 5/1972 Antosh ..... 517/516
3,963,385 A 6/1976 Caban ..... 517/517
4,142,846 A * 3/1979 Yoshikawa ..... 417/517

(Continued)

FOREIGN PATENT DOCUMENTS

DE 2933128 2/1981

(Continued)

OTHER PUBLICATIONS

International Search Report for corresponding PCT application No. PCT/EP2004/010352 dated Dec. 22, 2004.

*Primary Examiner*—Charles G Freay
(74) *Attorney, Agent, or Firm*—Van Dyker, Gardner, Linn & Burkhart, LLP

(57) ABSTRACT

In a two-cylinder slurry pump for the continuous feeding of, in particular, concrete, in which pump two feed cylinders remove the high-viscosity material from a pre-charging tank and deliver it to a feed line, a diverter valve is provided with a cross-section that narrows from an inlet opening assigned to the cylinders to a discharge opening assigned to the feed line, which diverter valve connects, in any position, at least one feed cylinder, over its entire cross-section, to the feed line, a support arrangement (20) and a plate cam (15) securely connected thereto being assigned in accordance with the invention to the diverter valve (11) on its side facing towards the cylinders (3, 5). The plate cam (15) comprises not only the inlet opening (21) of the diverter valve (11) but also an intake opening (23), which is arranged at sufficient distance from the inlet opening (21) to cover an opening of one of the feed cylinders (3, 5) completely. Additionally, a process for controlling this continuous-feed slurry pump is described.

25 Claims, 5 Drawing Sheets

U.S. PATENT DOCUMENTS 4,373,875 A 2/1983 Schwing ..... 417/517
4,543,044 A * 9/1985 Simmons ..... 417/342
4,563,135 A * 1/1986 Riker ..... 417/517
4,653,990 A * 3/1987 Schlecht ..... 417/517
5,993,181 A * 11/1999 Hudelmaier ..... 417/519

FOREIGN PATENT DOCUMENTS

DE 3219882 12/1983

* cited by examiner

FIG. 2
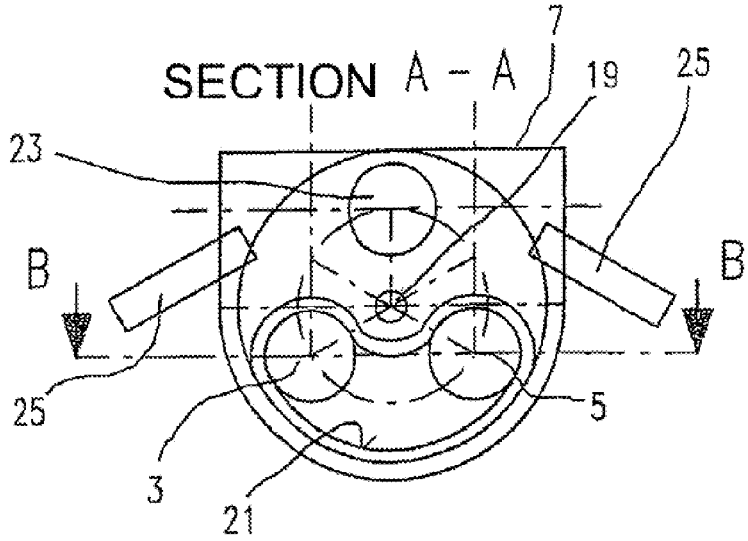
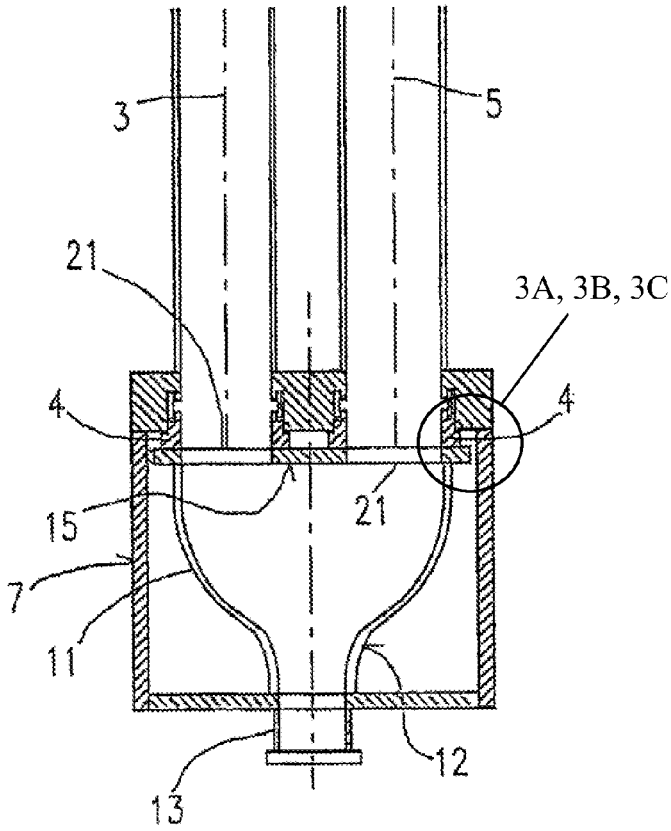
FIG. 3

RECIPROCATING SLURRY PUMP WITH A CONTINUOUS FEED RATE

The present invention relates to a slurry pump (also known as a sludge or thick-matter pump) comprising the features of the preamble of claim 1. In a broader sense, the invention also relates to the control of such slurry pumps.

In particular, reciprocating slurry pumps have been in use for a long time to supply concrete on building sites. In general, they are designed as hydraulically operated reciprocating pumps that usually comprise two cylinders and feed the concrete through tubes or pipes. For the sake of simplicity, the following specification will always refer to the delivery of concrete. The invention is not, however, restricted to an application in concrete feed pumps, as it can apply to all similar types of slurry pump.

Equipped with two alternately charged cylinders and associated rams, such pumps must supply a single feed line. In each case, the charged cylinder is connected to the feed line via a switchable diverter valve. The ram then discharges the concrete (pump lift), while the parallel ram is returned so as to recharge the cylinder with concrete (intake stroke). At the end of each stroke, the movement of the cylinder rams is reversed in each case and the diverter valve is repositioned, thus constantly alternating the pump and intake strokes. The two rams are preferably driven hydraulically and coupled together so as to operate in opposite directions at all times.

Conventional diverter valves (DE 29 33 128 C2) are configured such that they can reciprocate between two end switching positions in which they alternately make the connection between the cylinder openings and the feed line on the one hand, and the pre-charging tank on the other hand. In itself, this results in batch feeding.

In one particular type of design, the diverter valve includes a "skirt-type" gate valve, whose name derives from its outer shape and which is arranged within the pre-charging tank's feed zone that is filled with high-viscosity material. The "waist" of this skirt has a bore that corresponds to the discharge opening of the feed cylinders, whereas the "hem" of the skirt defines a roughly kidney-shaped opening.

By means of a drive mechanism, the skirt-type gate valve can be positioned in an arcuate sliding/pivoting movement between two end positions such that the waist opening is connected to a discharge opening of one of the cylinders in each end position, whereas the hem opening always communicates with the single feed line. In terms of the pump flow in this design, the waist opening is therefore upstream and the hem opening is downstream.

Because the discharge opening is exposed in each end position of the skirt-type gate valve, the cylinder in question can, during the intake stroke, be recharged with the high-viscosity material that flows past the skirt-type gate valve on the outside. Both end faces of the skirt-type gate valve on the hem and waist slide over suitable sealing faces, with the result that the high-viscosity material cannot emerge at the sides. This system does not, however, permit continuous feeding.

As the class-forming prior art, U.S. Pat. No. 3,663,129 describes a different concrete pump in which the changeover valve or its diverter valve comprises a skirt-type gate valve that is rotated through 180° with respect to the aforementioned prior art. As an outlet downstream, the valve's waist opening is connected constantly, albeit pivotably, to the mouth of the feed line. Its kidney-shaped hem opening (inlet, upstream) is long enough to cover the openings of the two feed cylinders simultaneously. When in operation, the diverter valve performs a continuously oscillating pivoting movement, the axis of which is coaxial to the feed-line mouth.

The pivoting angle of the diverter valve is approximately 50° at both sides of a central position.

By interacting with the momentary position of the diverter valve, the rams of the feed cylinders are controlled such that at the point when the two cylinder openings are covered by the hem opening, one cylinder has just reached the end of a pump lift while the other cylinder is about to start it. The feed process changes smoothly from one cylinder to the other. In the known control system, the same period of time is calculated for each ram's intake stroke and pump lift. In consequence, the two cylinders are not fed simultaneously.

Owing to the fact that this known diverter valve is only unilaterally supported on the side of the feed line and that the support and sealing faces define essentially only the hem opening, the considerable tilting moments that take effect cannot be effectively absorbed by the known structural design. For this reason, gaps are formed, under the delivery pressure, between the housing and the diverter valve, thus giving rise to considerable leakage losses in the sealing region between the diverter valve hem opening and the feed cylinders, which losses in turn make it doubtful that the feed process really does take place continuously.

The invention is based on the object, starting out from the class-forming prior art, of designing an improved continuous-feed slurry pump and of providing a process to control a slurry pump with a continuous feed rate.

This object is solved in accordance with the invention by means of the features of claim 1 with regard to the slurry pump, and by means of the features of parallel independent claim 17 with regard to the control process.

The features of the dependent claims that follow on from the independent claims in each case define advantageous extensions of the invention.

By additionally allocating a support arrangement to the diverter valve on its side that faces the cylinders, the diverter valve will be lent mechanical support, which avoids leaks under the pressure entailed by feed mode, thereby obtaining a pump that satisfies practical considerations for the continuous feeding of high-viscosity materials, in particular concrete. A plate cam that is securely connected to the diverter valve and comprises inlet and intake openings enables the forces acting on the diverter valve during pump mode to be reliably transferred to the support arrangement. The plate cam also includes planar portions that are provided to cover completely an opening of one of the feed cylinders. As a result, it is possible to precompress this cylinder's fresh charge.

The support arrangement on the cylinder side can be combined advantageously with the support arrangement for a diverter-valve drive shaft, thereby ensuring a simple and sturdy structure.

The changeover valve can be given a compact structural design in that, starting out from a central position in which both cylinders are connected to the feed line at the same time, the diverter valve and plate cam can be pivoted into opposite directions through 120° (2×60°) in each case, and in that the intake opening is located in front of one of the feed cylinders after each such pivoting movement through 120° (2×60°).

The class-forming prior art does indeed provide a diverter-valve pivoting angle that is smaller overall. Nonetheless this particular diverter valve, starting out from the central axis of the feed line, is much more offset, and the axes of the feed cylinders are further out of line with respect to the feed-line axis. This considerably increases the necessary space as well as increasing the leverage arising from any compressive and frictional forces and acting around the drive axis.

The plate cam itself can preferably be supported in a mechanically slidable manner on its circumference within the changeover-valve housing. This creates a broad basis for countering any forces acting upon the diverter valve. Wrap-around sealing of the plate-cam circumference within this housing gives this design a further advantage, since, in this advantageous extension, the high-viscosity material contained in the pre-charging tank is held in check immediately at the outer circumference of the plate cam rather than at the edges of the inlet or intake opening.

The control process as specified by the invention is characterised in that at the start of the pump lift of the ram of each feed cylinder, its opening is closed up by means of a plate-cam control or sealing face that runs ahead of the inlet opening of the diverter valve, with the ram of this feed cylinder performing a precompression stroke, while the ram of the other feed cylinder is in pump-lift mode, and that while both cylinder openings are covered by the inlet opening temporarily at the same time, the two rams are controlled in a synchronous phase so as to match one another such that the amount of high-viscosity material simultaneously pumped by the two rams is at least roughly the same as if it were being fed by just one ram during the intake stroke of the other ram. During the synchronous phase, both rams are preferably driven at the same speed, that is to say at about half the normal pump speed.

In accordance with a further advantageous embodiment, the intake stroke of each ram runs its course much more quickly than its pump lift. This approach gains time for the precompression stroke.

Finally, it may be an advantage to slow down the pivoting movement of the diverter valve or plate cam during certain movement phases or to have it omitted altogether.

Further details and advantages of the subject matter of the present invention are evident from the drawing of an exemplary embodiment and from its detailed description which follows below.

In simplified form,

FIG. 2 depicts the sectional view designated in FIG. 1 as A-A;

FIG. 3 depicts the sectional view designated in FIG. 2 as B-B;

Figure 1:
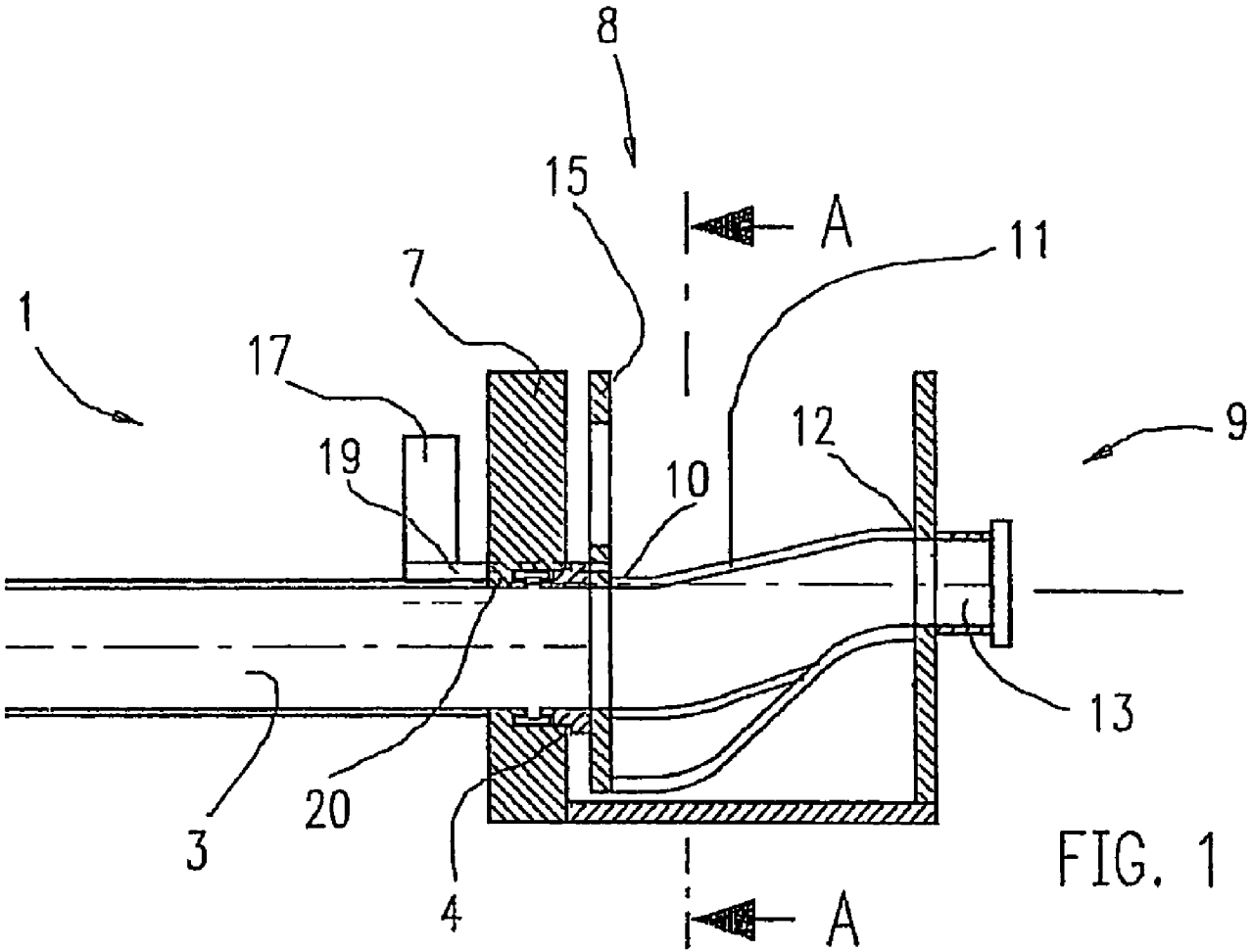
FIG. 1 depicts a sectional view of a changeover valve of a slurry pump in accordance with the invention in the region of the diverter valve.
Figure 3B:
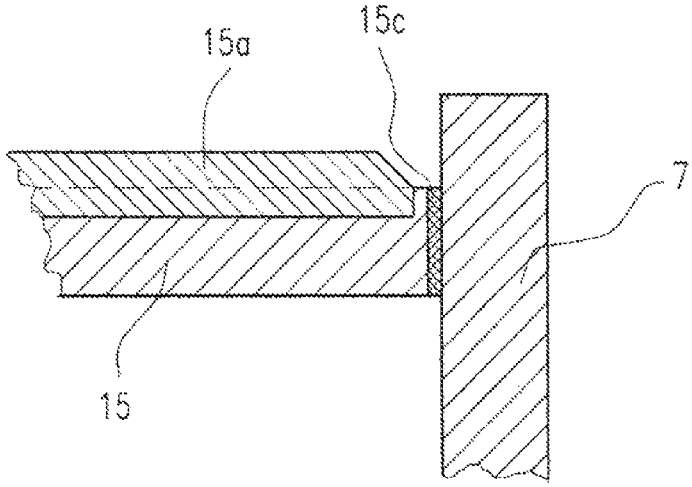
FIGS. 3A-3C depict various embodiments of the support for the cam plate of the diverter valve at the housing of the change over valve.
Figure 3A:
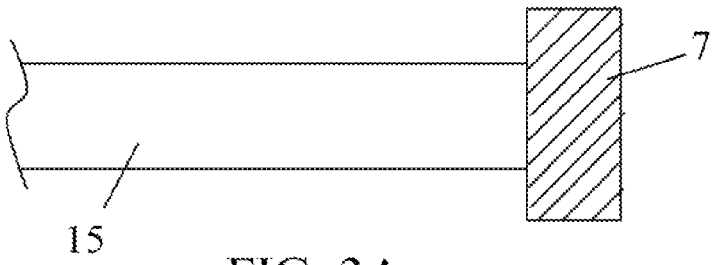

The only part of the slurry pump 1 shown in FIG. 1 is the feed cylinder 3, which is the front one in this view; this feed cylinder is depicted in the region of its open (discharge) end. The associated ram is not shown. The second feed cylinder 5 is concealed here, though it is visible in FIGS. 2 and 3. Both rams are driven independently of one another (preferably hydraulically) and can in principle assume any relative positions and speeds within the limits of their strokes and control mechanism. It is, however, possible to operate them in a hydraulically coupled manner, as well. The two cylinders and rams have the same diameter, e.g. 250 mm.

Open at the top, a bearing housing 7 of a changeover valve 9 is flanged onto the open ends of the two feed cylinders. The housing also forms at least one (lower) section of a precharging tank 8. The openings of both feed cylinders 3 and 5 open out near to the lower base of the pre-charging tank 8. Compared to the class-forming prior art, this has the advantage that when the high-viscosity material is sucked up, as large a level as possible always remains above the cylinder openings.

The changeover valve 9 includes a diverter valve 11 as a moving part. As in the prior art, this diverter valve is formed by a hollow body in the shape of a skirt-type gate valve. The hem 10 of the skirt faces towards the feed cylinders 3 and 5, and the waist 12 faces towards a feed line 13. In consequence, in terms of the flow of material being fed, the waist opening is downstream and the hem opening is upstream.

The waist opening 12 corresponds to the opening of the feed line 13 at the junction, and they are always connected together so as to be pressure tight. The feed line 13 has a diameter of e.g. 180 mm at this junction.

Within the housing 7 above the base of the pre-charging tank 8, the hollow body that forms the diverter valve 11 is supported rotatably or pivotably at the mouth of the feed line 13 and, in accordance with the invention, also on the opposite side facing towards the feed cylinders 3 and 5, which will be discussed further hereinbelow. The pivoting axis is positioned in the dead centre of the longitudinal axis of the end of the feed line 13 and, in the front elevation (FIG. 3), exactly between the feed cylinders 3 and 5.

The waist opening 12 can therefore be sealed relatively easily at the mouth of the feed line 13 (e.g. by means of rotary shaft seals), because only an equiaxed, purely rotationally oscillating relative movement of both tubular cross-sections arises there.

Nonetheless, a sliding seal 4 (only schematically indicated in FIG. 1), which has both an axial and a radial sealing function, is to be provided in each case at the mouths of the two feed cylinders 3 and 5, which open out near to the base of the housing 7. Provided on the cylinders, each sliding seal 4 is annular and has a clear diameter that corresponds to the cylinder diameter. In principle, the seals here may be conventional ones, the design of which is known per se; such seals may have to be adapted to the present extension.

A preferably circular plate cam 15 is connected securely to the hollow body of the diverter valve 11 on the skirt hem or on that side which faces towards the feed cylinders 3 and 5. Both parts might be manufactured integrally as a cast piece. Preferably, however, the cam is made as a turned part and welded or screwed to the diverter valve. A combined flat-slide and diverter valve is thus obtained as a whole. As will be explained later on, the cam 15 itself has a major valve and sealing function. As will also be explained below, the cam additionally assumes important mechanical stiffening and guidance functions, which set the inventive design apart from the prior art according to the class. In particular, the plate cam 15 stiffens the relatively thin-walled hollow body of the diverter valve 11 to such a large extent that the hollow body does not undergo any considerable deformations during operation.

A variation on the depiction in FIG. 1 is that the actual design of the changeover valve does not include any gap, or includes just an extremely narrow gap, between the surface of the cam 15—which surface points towards the feed cylinders 3 and 5—and the inner wall of the housing 7. This version, too, will be discussed in more detail below. It should merely be pointed out at this juncture that it will be necessary to seal very carefully those parts which can move against one another, viz., on the one hand, the diverter valve 11 together with the cam 15 and the edges of the openings within the cam 15, and, on the other hand, the housing wall 7 or the discharge or intake openings of the feed cylinders 3 and 5, thereby obtaining crucial improvements over the class-forming prior art. Moreover, the cam 15 is preferably supported, along the whole of its periphery (FIG. 3A), on the inner housing wall 7 so as to provide as broad a mechanical basis as possible to counter any forces taking effect.

A lever 17, which serves to introduce drive forces into the changeover valve 9 or into the diverter valve 11 via a drive shaft 19 that is partially concealed here, is schematically indicated above the feed cylinder 3 outside the housing 7. The drive shaft 19 is preferably coaxially located on the pivoting axis of the diverter valve 11 and is securely connected thereto. In this case, its support arrangement 20 within the housing 7 can likewise be used as the diverter valve's aforementioned support arrangement on the cylinder side.

Of course it would also be possible or necessary to support both parts separately if, for example, a coupling (not shown) that is not suitable for transferring radially acting (support) forces is to be provided between the drive shaft 19 and diverter valve 11. What is important is that the diverter valve 11 is supported, with respect to or on the inner wall of the housing 7, in a reliable and pivotable manner so as to counter the considerable tilting moments exerted on the valve's inner walls by the injected high-viscosity material. At the same time, this minimizes the impact of excessive forces upon the seals to be provided between the diverter valve and the housing wall and completely avoids unnecessarily straining these seals.

At all events, external influences on the diverter valve cause any tilting moments to be reliably absorbed by its two-sided support arrangement and, furthermore, prevent the formation of gaps through which the compressed high-viscosity material might escape and reenter the pre-charging tank.

FIGS. 2 and 3 illustrate further the shape and function of the diverter valve 11 (whose hollow body can be made for example as a relatively thin-walled casting) and of the cam 15.

FIG. 2 clearly shows a kidney-shaped opening 21 and a circular opening 23 in the circular cam 15. The former follows a circular portion that is aligned centrically with the central axis of the cam 15. It is on this axis that it extends across approx. 120°, with the circular portions that define its longitudinal sides being equidistant. This distance corresponds to the diameter of the feed cylinders, i.e. it likewise amounts to 250 mm. The kidney-shaped opening is rounded at the ends with a radius corresponding to that of the cylinder openings, i.e. approx. 125 mm. The mid-points of these terminal radii are offset by 120° on the circular portion.

The mid-point of the circular opening 23 is as far apart from the central axis of the cam as the kidney-shaped opening 21. The opening 23 is equidistant from both terminal mid-points of the kidney-shaped opening 21. In other words, there is, in each case, an angle of 120° between the mid-points of the terminal radii of the kidney-shaped opening 21 and the midpoint of the circular opening 23.

The two planar portions of the cam 15, which portions are located on both sides of the circular opening 23, are at least as wide as the diameters of the cylinders 3 and 5. In certain positions of the diverter valve 11 or cam 15, therefore, these portions are suitable for sealing the opening of either cylinder 3 or 5 in a manner that is complete and (by means of the seals that surround the cylinder openings) tight.

Additionally, it can be identified that the diverter valve 11 has an outline that is roughly kidney-shaped in the sectional region. The inside dimensions or diameters of the two openings 21 and 23 within the cam 15 correspond to the clear diameters of the feed cylinders 3 and 5.

In any conceivable position of the diverter valve 11, at least one opening of a feed cylinder 3 or 5 will always be completely open and connected to the feed line 13.

The structural design of the cam 15 as a flat-slide valve in cooperation with the seals, and the layout of the opening 23 simultaneously prevent any direct contact between the depressurised tank and/or the high-viscosity material contained therein, on the one hand, and the feed line, on the other hand. At no time is there a risk of a return flow from the feed line to the pre-charging tank.

FIG. 2 schematically indicates (preferably hydraulic) drive cylinders 25 that project, on both sides, above the housing 7 and are connected to the lever 17 via coupling members (not shown) and to the diverter valve 11 and cam 15 via the drive shaft 19 (FIG. 1). The drive cylinders 25 can pivot the diverter valve 11 across a relatively broad angular range in a discontinuously oscillating manner (cf. the phases in FIG. 4).

Of course, instead of being coupled to drive cylinders, the drive shaft 19 might also be coupled to a suitable direct rotary drive (electric motor, hydraulic rack-and-pinion cylinder).

FIG. 3 clearly shows the arrangement of the diverter valve 11 (to be regarded as a skirt-type gate valve here) with its upstream hem opening and downstream waist opening. As was the case in FIG. 1, it is possible to identify the axially fixed connection between the skirt waist 12 and the feed line 13. Both feed cylinders 3 and 5 are sealed by means of sliding seals 4 against the diverter valve.

It can also be identified that both feed cylinders 3 and 5 can be connected to the feed line 13 simultaneously and with their entire cross-section via the diverter valve 11, depending on the actual position of the diverter valve 11 and cam 15.

High-viscosity material flows—via the pre-charging tank (not shown here)—from the open upper side of the housing 7, which is illustrated in simplified form as box here, and enters the housing; the material does not, however, enter the diverter valve 11 directly, but merely flows round the outside of the its hollow body. Instead, only the circular opening 23 of the cam 15 serves to supply the high-viscosity material to the two feed cylinders 3 and 5, once this cam has been pivoted into the appropriate charging position (cf FIG. 4 once more). The opening 23 can therefore be referred to as a charging or intake opening of the cam 15; it also has a valve or directional function.

In detail, the following basic conditions must be complied with whenever the cam 15 is sealed against the housing 7: the cam must be sealed at the hem opening 21 of the diverter valve 11 during feed mode (pump lift of the feed cylinders), and at the circular opening 23 during intake mode.

A separately replaceable wear plate (15*a*) (FIG. 3B) should preferably be arranged on the inner wall of the housing 7 in a manner known per se. This forms the basis for the necessary sliding movements that are performed by the diverter valve 11 or cam 15 with respect to the housing wall 7 during pivoting.

In contrast, the two openings 21 and 23 should be equipped with cutting rings that surround these openings in the manner of a frame and which are in direct contact with the aforementioned wear plate and/or the seals 4. In the case of the intake opening 23, the cutting ring may be circular, in the case of the hem opening 21, the ring accordingly has a kidney-shaped outline.

In turn, the cutting rings are preferably detachably connected to the diverter valve 11 or cam 15 in order that they can be separately replaced if worn down. They are sealed from the adjoining parts by means of flexible (axial) seals in a manner known per se.

Figure 3C:
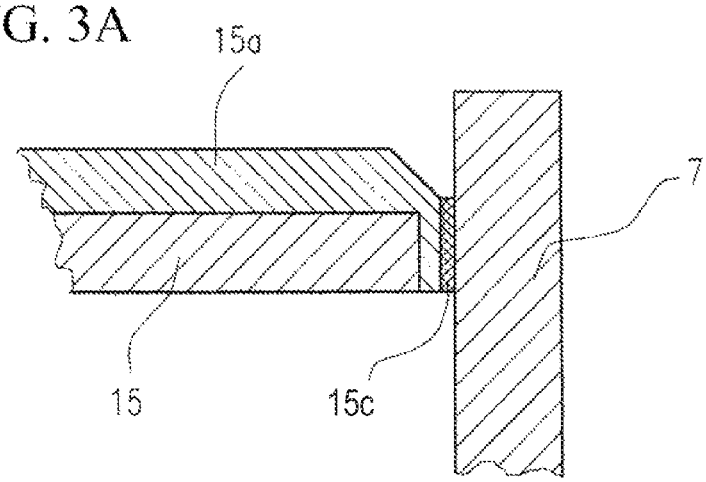

Finally, it is advantageous for the entire outer circumference of the cam 15 to be sealed against the pre-charging tank even if no elevated pressure load arises there. Nevertheless, such a circumferential external seal (15*c*) (FIG. 3B) greatly reduces the load affecting the pressurized seals around the openings 21 and 23 as a result of the abrasive constituents in the high-viscosity material (concrete), thus possibly extending the replacement intervals. It is possible to let the circumferential seal of the cam 15 run on the same wear plate as the cutting rings, whereby the wear plate (15*a*) must have at least the same diameter as the cam 15 (FIG. 3C). It is, however, also possible to provide a separate wear ring on which just the wear seal (15*c*) of the cam 15 runs. If this is the case, it would be possible to replace the wear ring and the (smaller) wear plate separately.

At the same time, a sliding seal along the entire cam circumference provides the diverter valve with reliable and axial support, and, if necessary, with radial support too (which will be determined by the actual design); this assists the valve's support arrangement on a broad basis and minimises the effect of any tilting moments introduced into the diverter valve 11.

As a variation on the depicted version, it is not, however, absolutely necessary to design the intake opening within the cam 15 as an enclosed bore 23. Instead, a recess that is open towards the edge of the cam can be provided. The opening angle and contour of this recess nevertheless remains dependent on the requirement that sufficient surface area of the cam 15 should be left on both sides of the kidney-shaped opening 21 in order temporarily to reliably seal one opening of either feed cylinder 3 or 5 at a time. Of course, the shape of the cutting edge surrounding the borders of this recess must, moreover, be adapted in such a version.

Figure 4:
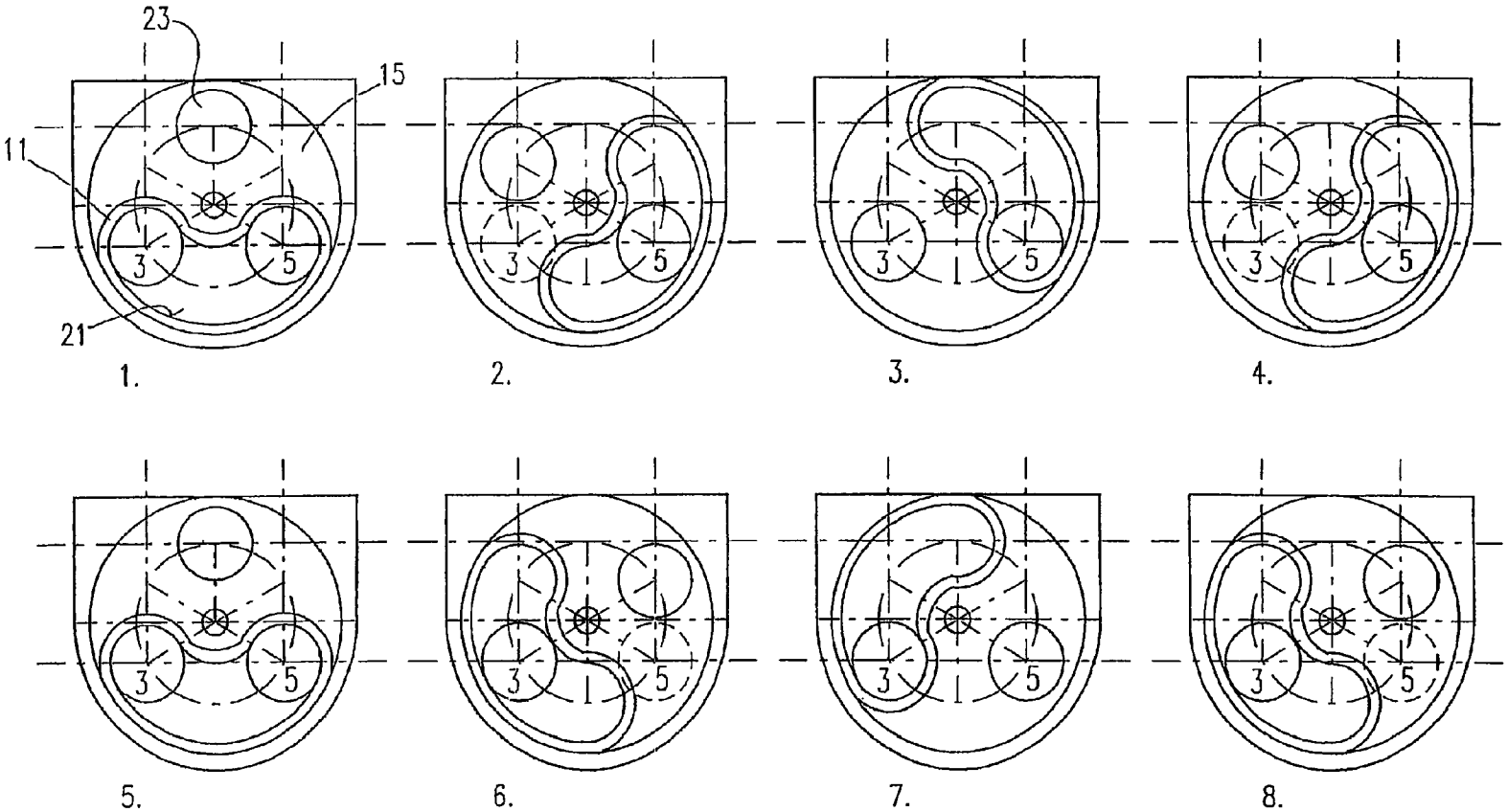
FIG. 4 depicts a phase representation of the movement sequences of the diverter valve in the same view as in FIG. 2.
Figure 5:
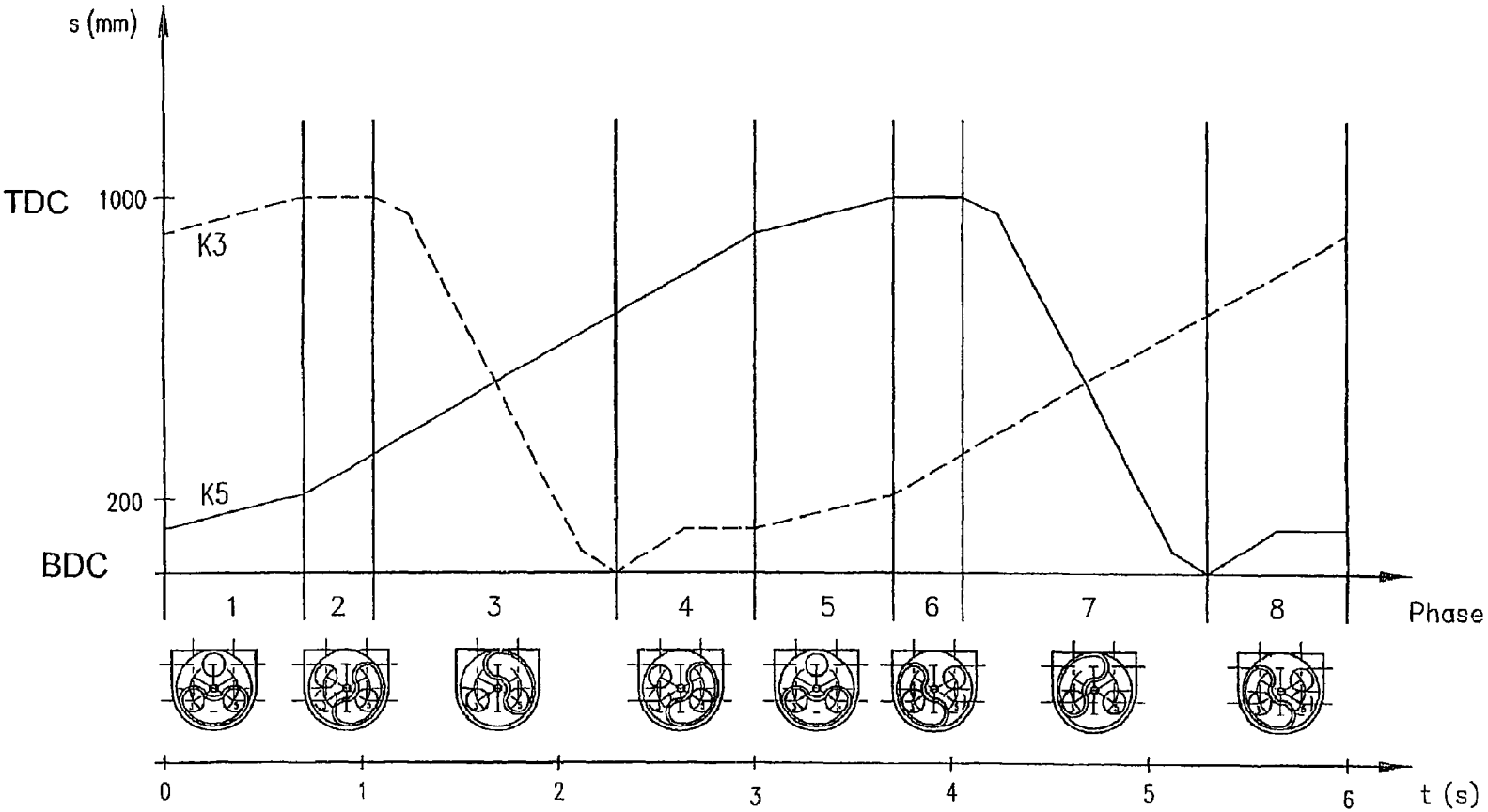
FIG. 5 depicts a path-time chart corresponding to the phases in FIG. 2; the chart relates to the strokes—controlled in an out-of-phase manner of the two slurry-pump rams.

After all the essential components of the slurry pump have been introduced, the actual feed process and the control of the slurry pump in accordance with the invention will now be portrayed and explained on the basis of the sequential phases of FIG. 4 and the path-time chart in FIG. 5.

The phases of FIG. 4, which correspond to the view in FIG. 2, will be explained line by line from the top left to the bottom right. In the chart in FIG. 5, the phases are plotted side by side over a time axis, separated by vertical lines and designated by the same numbers as in FIG. 4.

Below the succession of control steps, FIG. 5, by way of supplement, reproduces once more the associated positions of the diverter valve 11 and plate cam 15 on a reduced scale in order to facilitate an unambiguous allocation. The movement sequence of ram K3 of the feed cylinder 3 is a dotted line, while that of ram K5 of feed cylinder 5 is a continuous line.

In phase 1, the diverter valve 11 is in the position that is also shown in the aforementioned FIGS. 1 to 3 (henceforth referred to as the starting position). The kidney-shaped hem opening 21 simultaneously connects the two feed cylinders 3 and 5 to the feed line 13. The circular opening 23 is still without function. Neither of the feed cylinders communicates with the housing 7 or the pre-charging tank 8.

According to phase 1 of the chart, ram K3 of the feed cylinder 3 is at the end of its pump lift, whereas ram K5 of the (freshly charged) cylinder 5 is just beginning its new pump lift—following precompression. Both rams are shifted at a relatively low speed in parallel und in the same direction. This can be regarded as a "synchronous phase".

Phase 2 is a transition that the feed cylinder 3 undergoes between the pump lift and the intake stroke. The cam 15 is pivoted out of its starting position anticlockwise through 60°. The opening of the feed cylinder 3 is closed tight by the cam 15, its ram K3 may be stationary. This intermediate position is a reliable way to avoid any short circuit between the feed cylinder that is pumping and the other feed cylinder that is in intake mode.

In this relatively short phase, the cam 15 or diverter valve 11 can at most move slowly; it may be necessary for them to be stopped.

Meanwhile, ram K5 is still undergoing pump lift, as can be seen in phase 2 of the chart. The gradient of its movement is now steeper, however, i.e. its rate of advance has risen to a normal level compared to the preceding synchronous phase 1 (e.g. twice as fast). This ensures a constant flow of high-viscosity material within the feed line 13.

Phase 3 shows the first extreme or reversal position of the diverter valve 11, which, starting from phase 1, has now been pivoted anticlockwise through 120° and, starting from phase 2, through 60°. The circular opening 23 of the cam 15 is exactly in front of the feed cylinder 3. The kidney-shaped opening 21 still permits material to leave the feed cylinder 5 and be supplied to the feed line 13.

Phase 3 of the chart shows that ram K5 continues to operate at full speed or at full pump capacity, whereas ram K3 performs an intake stroke, preferably entailing gentle start-up and rundown, though overall at a higher rate than during pump lift ("intake phase").

In this phase, too, it may be advantageous to stop temporarily the oscillating movement of the diverter valve 11 in order that the intake stroke can run its course when the feed cylinder 3 is fully open.

The position of the diverter valve 11 in phase 4 of FIG. 4 corresponds to phase 2. The cam 15 has now left the reversal position and returned clockwise through 60° once more. As can be seen in the chart, however, ram K3 of the feed cylinder 3 (which has once more been closed by the cam 15) can now precompress the high-viscosity material (which has just been taken in) at a low speed via a very short stroke, preferably at the operating pressure prevalent in the feed line ("precompression phase"). With regard to the gases (air) taken in with the high-viscosity material and in terms of the back pressure coming from the feed line, this is advisable so as to avoid jolts in the system whenever the cylinder opening is re-released by the kidney-shaped inlet opening 21. Here, too, the diverter valve 11 can be stopped momentarily or at least slowed down.

Ram K5 is just entering the end phase of its pump lift, still at full speed.

In terms of the position of the diverter valve 11, phase 5 corresponds exactly to phase 1 (starting position, "synchronous phase"). Phase 5 of the chart also shows that rams K3 and K5 have reversed roles and are now beginning their out-of-phase cycle all over again with simultaneous pump feed at reduced speed. The diverter valve 11 now continues to pivot clockwise.

Phase 6 is a mirror inversion of phase 2; now only ram K3 is pumping at full speed, whereas the cam 15 closes the feed cylinder 5 tight and its ram K5 may be stationary according to phase 6 of the chart. The cam is pivoted out of the starting position clockwise through 60°.

Phase 7 corresponds to a mirror inversion of phase 3. The cam 15 or diverter valve 11 have reached their extreme or reversal position in a clockwise direction. The feed cylinder 5 is recharged. According to phase 7 of the chart, ram K5 of this feed cylinder returns to the starting position, and high-viscosity material subsequently flows through the circular opening 23 into the feed cylinder 5. At the same time, the feed cylinder 3 has full pump capacity and its ram has a full rate of advance.

In phase 8, which corresponds to a mirror inversion of phase 4, the ram of the feed cylinder 5 again precompresses the freshly filled high-viscosity material, while the ram of the feed cylinder 3 enters the end phase of its pump lift. The chart has now concluded a full operating cycle of the two-cylinder slurry pump, the sequence continues anew with phase 1.

To illustrate the speeds, pressures and forces that arise during slurry pump operation in continuous-feed mode, it should be mentioned that the entire sequence of phases 1 to 8 takes place in just 6 seconds, as indicated by the captioned time axis beneath the chart. The rams of the feed cylinders must pass through strokes approx. 1 m in length.

To interpret the chart in FIG. 5 further, it should first be repeated that during phases 1 and 5, both rams simultaneously pump high-viscosity material into the feed line 13. During this phase, their speeds are adapted to one another such that the total amount of material fed by them corresponds to that of a ram on its own at its normal rate of advance. This approach, together with the precompression phase of the ram that is starting up again, ensures that the slurry pump's discharge rate is constant and more or less smooth.

In all other phases, only one of the rams is in pump mode at any one time, and in this instance, the ram preferably operates at a constant speed.

The inventive design of the changeover valve and the selective control of the ram advance rate make it possible to obtain a constant slurry-pump discharge compared to a ram's individual pump capacity during the phases of joint pump lift, thereby virtually eliminating the pulsation of the flow of high-viscosity material within the feed line 13. This particularly benefits from the precompression of high-viscosity material in phases 4 and 8, which precompression avoids connection of a depressurised "buffer zone" to the feed line 13 whenever the freshly charged feed cylinder 3 or 5 is opened.

Although considerable forces are exerted upon the diverter valve 11 as a result of the precompression stage, these forces are cushioned by the valve's inventively sturdy and yet comparatively simple support arrangement on both sides. Once again, the advantages of a pure rotational (pivoting) support arrangement and of the constant connection of the downstream end of the diverter valve 11 to the feed line 13 come in useful here.

The positions of the rams and the diverter valve 11 plus the plate cam 15 are detected by suitable sensors (distance and/or angle position sensors), if necessary directly at the respective drives, or on the circumference of the plate cam 15. These sensors supply their positional signals to a preferably central slurry-pump control unit that in turn controls the drives for the rams and the diverter valve 11.

In particular, the unit controls a reduction in the rates of advance at the moment when both openings of the feed cylinders are simultaneously covered. Both rams do not necessarily have to be reduced to half-speed, but in principle, moreover, the one ram might be controlled for example to ⅓ full speed and the other to ⅔ full speed (so long as the diameters and total strokes are identical). The aim continues to be as constant a feed rate as possible for the high-viscosity material within the diverter valve 11 or feed line 13.

In addition, during the time in which the freshly charged feed cylinder is closed by the cam 15, the control unit must, on the one hand, temporarily stop the diverter valve or switch to slow mode, and, on the other hand, control the precompression stroke of the associated ram. This may, in addition, necessitate a pressure sensor that can be placed within the cylinder, ram, or pressurized diverter valve 11 or cam 15 connected thereto. Of course, obstruction of the cam 15 caused by excessive pressure must be ruled out for certain.

Furthermore, delayed operation of the diverter valve and plate cam 15 or even a temporary rest between the reversal points, too, may be advantageous in other phases, e.g. the synchronous phases and intake phase. Overall, it will be necessary to weigh up carefully the diverter valve's rest times and pivoting times in order that, on the one hand, the flow cross-sections are not too greatly reduced by any overlaps between the cam-plate control surfaces and the feed-cylinder openings and that, on the other hand, no excessive pivoting speeds are entailed.

BEZUGSZEICHENLISTE/LIST OF REFERENCE NUMBERS

1 Dickstoffpumpe/Slurry pump
2
3, 5 Förderzylinder/Feed cylinders
4 Gleitdichtung/Sliding seal
6
7 Gehäuse/Housing
8 Vorfüllbehälter/Pre-charging tank
9 Umschaltventil/Changeover valve
10 Saum/Hem
11 Rohrweiche/Diverter valve
12 Taille (Taillenoffnung)/Auslaβöffnung/Waist (waist opening)/discharge opening
13 Förderleitung/Feed line
14
15 Steuerscheibe/Plate cam
16
17 Hebel/Lever
18
19 Antriebswelle/Drive shaft
20 Lagerung/Support arrangement
21 Einlassöffnung/Inlet opening
23 Ansaugöffnung/Intake opening
24
25 Antriebszylinder/Drive cylinders ((zu den Zeichnungen))

((FIG. 2 u. 3))

SCHNITT A-A=SECTION A-A

SCHNITT B-B=SECTION B-B ((FIG. 5))

OT=TDC

UT=BDC

The invention claimed is:

1. A two-cylinder slurry pump for the continuous feeding of high-viscosity material, said pump comprising:

first and second feed cylinders;

a precharging tank;

a feed line, said feed cylinders for removing high-viscosity material from said pre-charging tank and delivering the high-viscosity material to said feed line; and a changeover valve having a pivotable diverter valve for switching between said first feed cylinder and said second feed cylinder, said diverter valve having an inlet opening assigned to said feed cylinders, a discharge opening assigned to said feed line, and a side facing said cylinders and comprising:

a hollow body having a cross-section that narrows from said inlet opening to said discharge opening;

said hollow body being pivotably supported in the region of said discharge opening about a pivot axis and positionable for connecting at least one of said first feed cylinder and said second feed cylinder to said feed line in any position of said changeover valve; and a support arrangement and a plate cam securely connected thereto are assigned to said diverter valve on said side facing said cylinders of said diverter valve towards said cylinders, said plate cam including a first opening forming said inlet opening of said diverter valve, and said plate cam further including a second opening forming an intake opening arranged at a sufficient distance from said inlet opening to allow said cam plate to close one of said feed cylinders completely.

2. A slurry pump in accordance with claim 1, wherein said changeover valve includes a housing, said diverter valve being securely connected to a drive shaft supported within said housing of said changeover valve, and said support for said drive shaft within said housing also serving as support for said diverter valve.

3. A slurry pump in accordance with claim 1, wherein said diverter valve and said plate cam have a central position wherein both of said cylinders are connected to said feed line at the same time and said plate cam can be pivoted from said central position into opposite directions through 120° in each case so as to position said intake opening in front of one of said feed cylinders one at a time.

4. A slurry pump in accordance with claim 1, wherein said inlet opening comprises a kidney-shaped inlet opening at the cylinder side, said kidney-shaped inlet opening extending across 120° along a circular arc and being rounded off at both its ends, and said intake opening, being on the same circumference as said kidney-shaped opening and being offset symmetrically through 120° with respect to both ends of said inlet opening.

5. A slurry pump in accordance with claim 1, wherein said feed cylinders each have a diameter, said intake opening comprising a bore in said plate cam, and said bore having a diameter that corresponds at least to said diameters of said feed cylinders.

6. A slurry pump in accordance with claim 1, wherein said intake opening in said plate cam corresponds at least to the diameter of one of said feed cylinders.

7. A slurry pump in accordance with claim 1, wherein said inlet opening is enclosed by a cutting ring.

8. A slurry pump in accordance with claim 1, further comprises at least one wear plate arranged on a lateral surface of said housing, said surface facing towards said diverter valve.

9. A slurry pump in accordance with claim 1, wherein said plate cam is slidably supported at its circumferential edge on a wall of said housing of said changeover valve.

10. A slurry pump in accordance with claim 9, wherein said plate cam has a circumferential support surface, said circumferential support surface providing a wrap-around sliding seal.

11. A slurry pump in accordance with claim 8, wherein said plate cam is slidably supported on said wear plate.

12. A slurry pump in accordance with claim 1, wherein said diverter valve is driven via a drive shaft by means of drive cylinders via a lever or by means of a rotary drive directly for the purpose of pivoting movements.

13. A slurry pump in accordance with claim 12, wherein at least said drive shaft is arranged between said feed cylinders.

14. A slurry pump in accordance with claim 1, wherein said plate cam is connected to said diverter valve in a detachable manner by means of screws or in a secure manner by welding.

15. A slurry pump in accordance with claim 1, wherein the openings of said feed cylinders open out near to the lower base of said precharging tank beneath said pivot axis of said diverter valve.

16. A process for controlling a slurry pump, said pump having two feed cylinders each with a ram, and a changeover valve having a movable diverter valve that can be controlled in a manner adapted to the movement of the rams, the diverter valve having an inlet opening and a discharge opening, the inlet opening of said diverter valve being designed for simultaneously closing both feed cylinders in at least one position of said diverter valve) the discharge opening of said diverter valve communicating with a feed line, and said diverter valve being provided with a plate cam with sealing faces that close of at least one feed cylinder in predetermined positions of said diverter valve, said method comprising:

closing each feed cylinder with the sealing face of the plate cam of said diverter valve;

performing a precompression stroke with the ram of one feed cylinder while operating the ram of the other feed cylinder in a discharge mode;

controlling both rams so that they are advanced in parallel in the same direction to define a synchronous phase while both cylinder openings are covered temporarily at the same time by the inlet opening so as to match one another such that the amount of high-viscosity material simultaneously pumped by both rams is at least roughly the same as if it were being fed by just one ram during the intake stroke of the other ram.

17. A process in accordance with claim 16, further comprising providing each discharge mode of a ram at least one precompression phase where the high-viscosity material is compressed, a first synchronous phase where both rams advance in parallel in the same direction, a pump phase where the ram advances at full speed while the feed cylinder of the other ram is closed, and a second synchronous phase where both rams advance in parallel in the same direction.

18. A process in accordance with claim 16, further comprising driving both rams at reduced speed and pump capacity during the synchronous phases.

19. A process in accordance with claim 18, further comprising driving both rams at the same speed during the synchronous phases, in particular.

20. A process in accordance with claim 16, further comprising providing each intake stroke of a ram a start-up speed and a rundown speed at a lower speed.

21. A process in accordance with claim 16, further comprising executing the intake stroke of each ram faster than its discharge stroke.

22. A process in accordance with claim 16, further comprising delaying or temporarily stopping the diverter valve during a precompression phase where the high-viscosity material is compressed prior to flowing into the diverter valve.

23. A process in accordance with claim 16, further comprising delaying or temporarily stopping the diverter valve during the synchronous phase.

24. A process in accordance with claim 16, further comprising delaying or temporarily stopping the diverter valve during a relaxation phase.

25. The process in accordance with claim 19, further comprising driving both rams at half the normal speed of the rams' discharge mode during the synchronous phase.

* * * * *

UNITED STATES PATENT AND TRADEMARK OFFICE

CERTIFICATE OF CORRECTION

PATENT NO. : 7,771,174 B2
APPLICATION NO. : 10/572821
DATED : August 10, 2010
INVENTOR(S) : Manfred Lenhart It is certified that error appears in the above-identified patent and that said Letters Patent is hereby corrected as shown below:

Column 11
Claim 1, Line 6, Delete "towards said cylinders" before ", said plate"

Column 12
Claim 16, Line 15, Delete "of" before "at least"
Claim 19, Line 43, Delete ", in particular" after "phases"

Signed and Sealed this
Fifteenth Day of February, 2011

David J. Kappos

David J. Kappos
*Director of the United States Patent and Trademark Office*